US007664422B2

(12) United States Patent
Shida et al.

(10) Patent No.: US 7,664,422 B2
(45) Date of Patent: Feb. 16, 2010

(54) IMAGE FORMING SYSTEM AND SHEET HUMIDIFYING APPARATUS

(75) Inventors: Toshio Shida, Higashiyamato (JP); Hirofumi Kayahara, Hachioji (JP); Masashi Kougami, Saitama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 236 days.

(21) Appl. No.: 11/714,801

(22) Filed: Mar. 7, 2007

(65) Prior Publication Data

US 2007/0240640 A1 Oct. 18, 2007

(30) Foreign Application Priority Data

Apr. 14, 2006 (JP) ..... 2006-111674

(51) Int. Cl.
*G03G 21/20* (2006.01)
*G03G 15/00* (2006.01)
*B05C 1/06* (2006.01)

(52) U.S. Cl. ..... 399/97; 399/390; 399/406; 399/407; 118/258

(58) Field of Classification Search ..... 399/97, 399/390, 406, 407; 118/258
See application file for complete search history.

(56) References Cited

U.S. PATENT DOCUMENTS 5,797,318 A * 8/1998 Taylor et al. ..... 101/148
2007/0048048 A1 * 3/2007 Kougami et al. ..... 399/341

FOREIGN PATENT DOCUMENTS

| | | |
|---|---|---|
| JP | 4-58548 | 5/1992 |
| JP | 8-234636 | 9/1996 |
| JP | 09-236953 | 9/1997 |
| JP | 2000-226145 | 8/2000 |
| JP | 2004-191582 | 7/2004 |
| JP | 2006-78867 | 3/2006 |

OTHER PUBLICATIONS

Japanese Office Action dated Aug. 12, 2008.
Japanese Office Action dated Apr. 23, 2008.

* cited by examiner

*Primary Examiner*—David M Gray
*Assistant Examiner*—Joseph S Wong
(74) *Attorney, Agent, or Firm*—Finnegan, Henderson, Farabow, Garrett & Dunner, L.L.P.

(57) ABSTRACT

An image forming system, comprises an image forming section to form an image on a sheet; a fixing section to fix the image formed on the sheet; a sheet conveying passage to convey the fixed sheet; a humidifying roller arranged on the sheet passage and to humidify the sheet; a water supplying tank to feed water to the humidifying roller; an electric component; and a waterproofing member to protect the electric component from water.

16 Claims, 6 Drawing Sheets

IMAGE FORMING SYSTEM AND SHEET HUMIDIFYING APPARATUS

This application is based on Japanese Patent Application No. 2006-111674 filed on Apr. 14, 2006, in Japanese Patent Office, the entire content of which is hereby incorporated by reference.

BACKGROUND OF THE INVENTION

The present invention relates to an image forming system provided with a humidifying apparatus and the sheet humidifying apparatus for giving water to a sheet.

As the image formation by an electro-photographic process is well-known, an image is formed by a process by which a toner image is formed by the charge, exposure and development, the formed toner image is transferred onto the sheet, the toner image transferred onto the sheet is fixed.

In the fixing process in this process, it is conducted that the toner is fused by the heat and pressure, and the image is fixed on the sheet, however, at the time of that, the phenomenon that the water content is evaporated from the sheet by the heat, is generated. Further, when the sheet is exposed to the outside air after the fixing, the phenomenon that the sheet absorbs the water content from the outside air, is generated.

Because such an evaporation of the water content and an absorption of the water content occur at a different ratio on the front and rear surface of the sheet, there is a problem that the surging or curl is easily generated in the sheet.

The phenomenon that the concave and convex are formed in the sheet S as shown in FIG. 1(*a*), is called as the surging, and the phenomenon that the sheet S is curved in the one direction as shown in FIGS. 1(*b*), (*c*), is called as the curl.

For these phenomena, in each processing conducted on the sheet after image formation, because the problem which is the cause of trouble in the sheet conveyance or, processing, in the bookbinding process, a problem that the quality of the product completed by the image formation and after-processing like that a bulky booklet is formed is lowered, a problem that sheets delivered from the apparatus are not uniform, and the integration is difficult are occurred, a counter-measure for the surging and the curl is necessary.

In Tokkaihei (Unexamined Japanese Patent Publication) No 4-338060, a humidifying apparatus by which the water vapor is blown to the sheet is proposed, a humidifying apparatus using the humidification roller from a point in which the control of the water supply amount is excellent, the influence on the vicinity of humidifying apparatus by the water vapor is small, the apparatus can be made compact, noticed, and this kind of humidifying apparatus is considered, and a humidifying apparatus by which in U.S. Pat. No. 5,895,154, Tokkai No. 2006-8282, the water is supplied from the water supply tank to the humidification roller, and the sheet is humidified, is disclosed.

In the humidifying apparatus, the electrical equipment such as a motor for the sheet conveyance, a solenoid for driving the gate for switching the conveyance path, DC power source which is the power source for them, control substrate, each kind of switch, is provided, however, because the humidifying apparatus accommodates the water for the humidification, and there is a possibility that the water content is affixed to the electrical parts, and their performance is lowered, or the accident such as electrical leaking is generated, it is necessary to protect the electrical parts from the water.

In the processing apparatus using the ordinary water, the protection section by which the electrical parts are protected from the water vapor is used, however, in the sheet humidifying apparatus using the humidification roller, in the water supply tank for supplying the water to the humidification roller, because the structure in which the free water surface is in contact with the outside air is used, only the water proof for the water vapor, is not enough, a counter measure to protect that the water is splashed from the free water surface by the vibration, and affixed to the electrical parts, is necessary.

SUMMARY OF THE INVENTION

The object of the present invention is to provide an image forming apparatus and a sheet processing apparatus by which, in a humidifying roller, and a humidifying apparatus having the water supplying tank for feeding water to the humidifying roller, electrical parts are protected from the water, and with which the durability and safety become high.

The above object can be attained by the following image forming system and the following sheet processing apparatus reflecting an aspect of the present invention.

(A) The image forming system, comprises:
- an image forming section to form an image on a sheet;
- a fixing section to fix the image formed on the sheet;
- a sheet conveying passage to convey the fixed sheet;
- a humidifying roller arranged on the sheet passage and to humidify the sheet;
- a water supplying tank to feed water to the humidifying roller;
- an electric component; and
- a waterproofing member to protect the electric component from water.

(B) The image forming system, comprises:
- an image forming section to form an image on a sheet;
- a fixing section to fix the image formed on the sheet;
- a sheet conveying passage to convey the fixed sheet;
- a humidifying roller arranged on the sheet passage and to humidify the sheet;
- a water supplying tank to feed water to the humidifying roller; and
- an electric component;
- wherein the electric component is arranged at a position above the level of water accommodated in the water supplying tank.

(C) The sheet processing apparatus, comprises:
- a sheet conveying passage to convey a sheet;
- a humidifying roller arranged on the sheet passage and to humidify the sheet;
- a water supplying tank to feed water to the humidifying roller;
- an electric component; and
- a waterproofing member to protect the electric component from water.

(D) The sheet processing apparatus, comprising:
- a sheet conveying passage to convey a sheet;
- a humidifying roller arranged on the sheet passage and to humidify the sheet;
- a water supplying tank to feed water to the humidifying roller; and
- an electric component;
- wherein the electric component is arranged at a position above the level of water accommodated in the water supplying tank.

DETAILED DESCRIPTION OF THE PREFERRED EMBODIMENT

Figure 1:
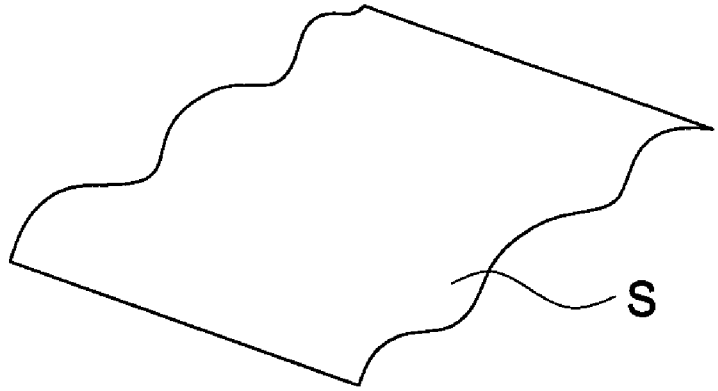
FIG. 1 is a view showing the surging and the curl of a sheet.
Figure 1:
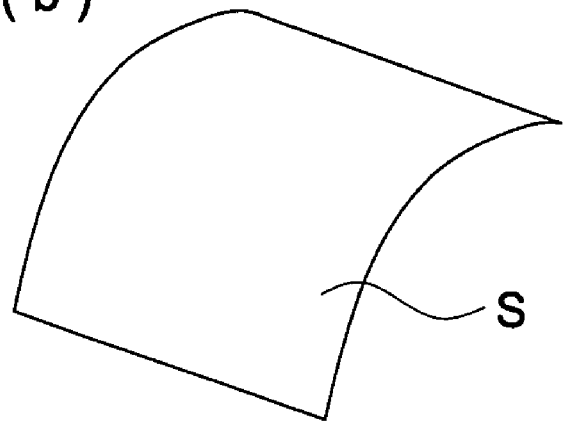
Figure 1:
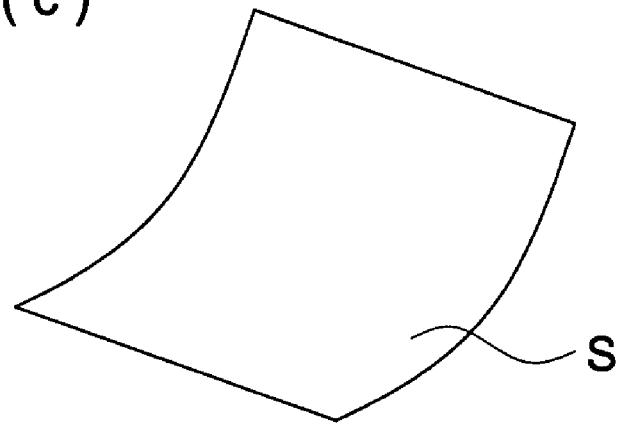

Hereinafter, preferable embodiments of the present invention are explained, however, the present invention is not limited to these preferable embodiments.

Firstly, preferable embodiments to attain the above objects are explained.

Item 1. In a sheet humidifying apparatus provided with a humidifying section having a humidifying roller and a water supplying tank to supply water to the humidifying roller and to humidify the sheet, the sheet humidifying apparatus is characterized, in that there is provided with a waterproofing member to protect an electric component from water.

Item 2. The sheet humidifying apparatus described in Item 1 is characterized in that the humidifying section is detachable.

Item 3. The sheet humidifying apparatus described in Item 1 or 2 is characterized in that the electric component is arranged below water level in the water supplying tank.

Item 4. The sheet humidifying apparatus described in any one of Items 1 to 3 is characterized in that further comprises a tank to supply water from a lower position to the water supplying tank.

Item 5. The sheet humidifying apparatus described in Item 4 is characterized in that the tank is detachable.

Item 6. In a sheet humidifying apparatus provided with a humidifying section having a humidifying roller and a water supplying tank to supply water to the humidifying roller and to humidify the sheet, the sheet humidifying apparatus is characterized in that an electric component is arranged above water level in the water supplying tank.

Item 7. The sheet humidifying apparatus described in Item 6 is characterized in that the humidifying section is detachable.

Item 8. The sheet humidifying apparatus described in Item 6 or 7 is characterized in that further comprise a tank to supply water to the water supplying tank.

Item 9. The sheet humidifying apparatus described in Item 8 is characterized in that the tank is detachable.

Item 10. The sheet humidifying apparatus described in any one of Items 6 to 9 is characterized in that further comprise an electric component arranged below water level in the water supplying tank and a waterproofing member to protect the electric component arranged below from water.

Item 11. An image forming system is characterized to comprise:

an image forming apparatus having an image forming section to form an image on a sheet and a fixing section to fix the image formed on the sheet; and the sheet humidifying apparatus described in any one of Items 1 to 10.

The present invention is described by the embodiment shown in the drawings, however, the present invention is not limited to the embodiment.

Figure 2:
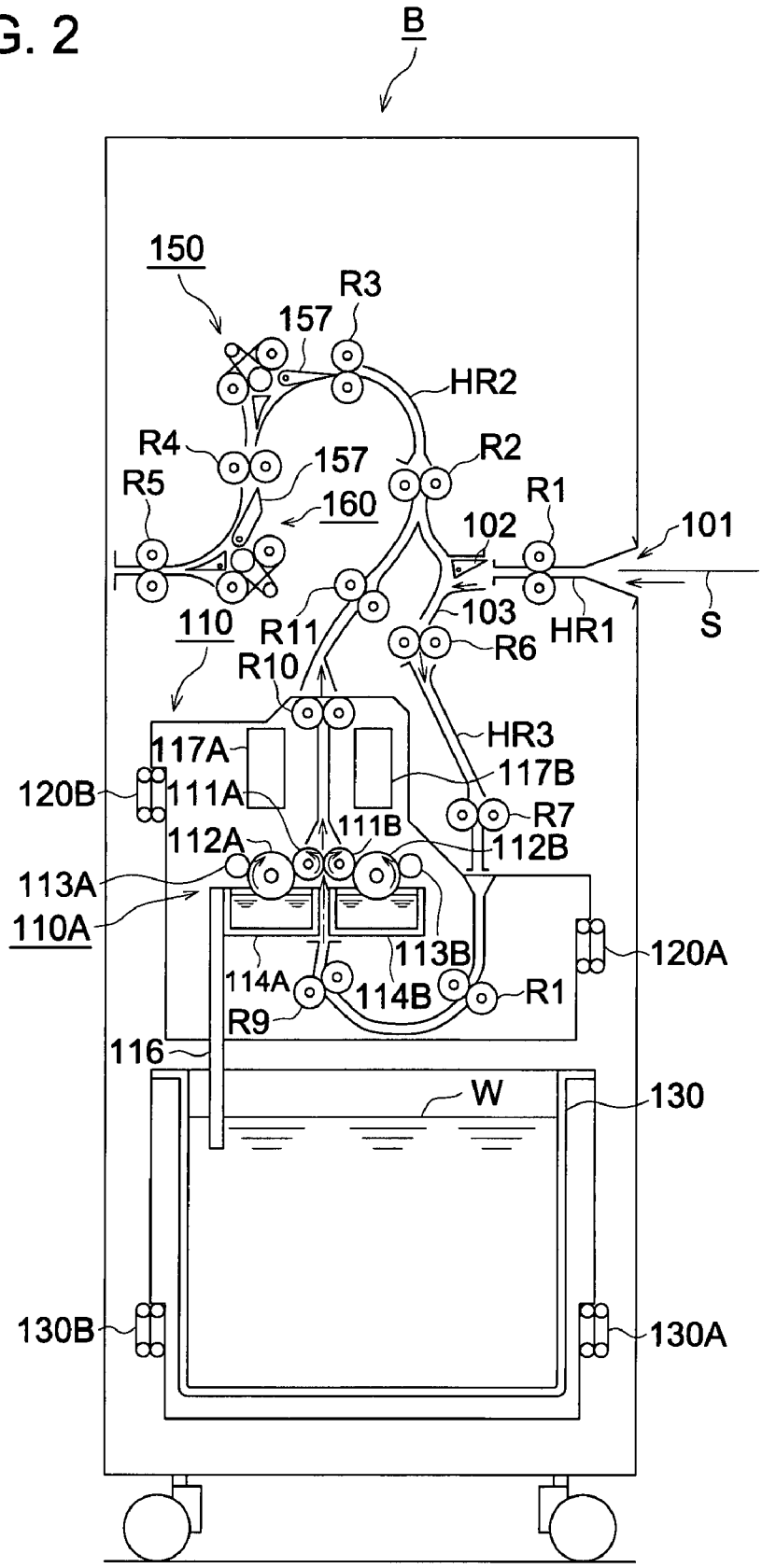
FIG. 2 is a front sectional view of the sheet processing apparatus having a humidifying apparatus in the embodiment of the present invention.

FIG. 2 is a front sectional view of the sheet processing apparatus provided with the sheet humidifying apparatus according to the embodiment of the present invention.

The sheet S image formed in the image forming apparatus (will be described later), is processed after it is introduced from the inlet 101 into the conveyance path HR1 of the sheet processing apparatus B, selectively passed the conveyance path HR2, HR3, and processed, and delivered from the sheet processing apparatus.

The sheet processing apparatus B has a no process mode in which the sheet S is only conveyed and the processing is not conducted, a humidification mode in which only the humidification processing is conducted, and the curl correction is not conducted, the first curl correction mode in which the humidification is not conducted and only the curl correction is conducted, and the second curl correction mode in which the humidification and the curl correction are conducted.

In no processing mode in which the processing by the sheet processing apparatus B is not conducted on the sheet S, and in the curl correction mode in which the humidification is not conducted and only the curl correction is conducted on the sheet S, the sheet S passes the conveyance paths HR1 and HR2.

In the humidification mode in which only the humidification is conducted on the sheet S, and in the second curl correction mode in which the humidification and the curl correction are conducted on the sheet S, the sheet S passes the conveyance paths HR1, HR3 and a part of HR2. The selection of the conveyance paths HR2, HR3 is conducted by the switching gate 102.

In the conveyance path HR2, the curl correcting sections 150, 160 are arranged, by the curl correcting section 150, the lower curl, that is, the curl in which the central portion is a valley, is corrected, and in the curl correcting section 160, the upper curl, that is, the curl in which the central portion is a mountain, is corrected.

In the conveyance path HR3, the humidifying section is arranged. The humidifying section is formed into a unit which can be taken from the apparatus by the guide of the rails 120A, 120B.

In the conveyance path HR1, the sheet S is conveyed by a conveyance roller R1, in the conveyance path HR2, the sheet S is conveyed by the conveyance rollers R2-R5. In the conveyance path HR3, the sheet S is conveyed by the conveyance rollers R6-R11.

Below the humidifying section 11, the tank 130 is arranged, the tank 130 is formed into a unit which can be taken from the apparatus, by the guide of rails 130A, 130B. The humidifying section 110 and the tank 130 structures the sheet humidifying apparatus according to the embodiment of the present invention.

Figure 3:
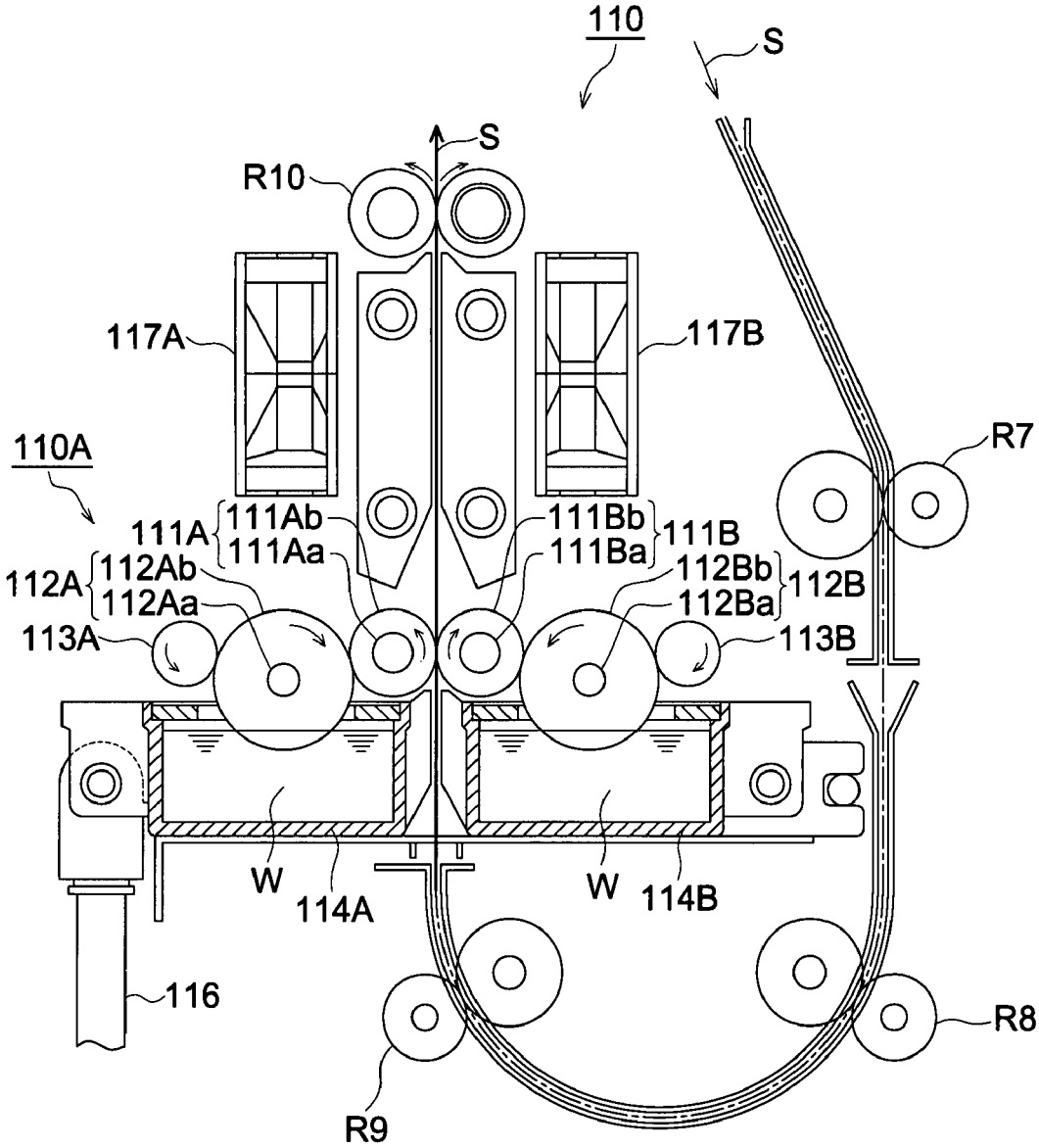
FIG. 3 is an enlarged view of the humidifying apparatus.

FIG. 3 is an enlarged view of the main section of the humidifying apparatus according to the embodiment of the present invention.

The conveyance path HR3 is formed into U letter shape, the sheet S advances below almost vertically from the conveyance path HR1 (shown in FIG. 1) of the sheet S, and advances above in the vertical direction, however, the humidifying sections 110A, 110B are arranged left and right symmetrically with the part of the conveyance path HR3 advancing above.

The humidifying section 110 consists of a pair of humidifying sections, that is the humidifying section 110A in the left of View and the humidifying section 11B in the right, the humidifying section 110A has the humidification roller 111A, the water supply roller 112A, and the water supply tank 114A, and the humidifying section 110B has the humidification roller 111B, the water supply roller 112B, and the water supply tank 114B. The humidification rollers 111A and 111B nip-convey the sheet S, while rotated in the arrow mark and convey the sheet S, the water is given to the sheet S and the humidification is conducted.

The water supply roller 112A is brought into contact with the humidification roller 111A, the water supply roller 112B is respectively brought into contact with the humidification roller 111B, the water supply roller 112A is submerged in the water W accommodated in the water supply tank 114A, and the water supply roller 112B is respectively submerged in the water W accommodated in the water supply tank 114B.

Numerals 113A, 113B are control member, and squeeze the water supply rollers 112A, 112B, and regulate these water content amounts.

The humidification roller 111A is structured by the axial core 111Aa formed of metal and the rubber layer 111Ab formed thereupon, the humidification roller 111B is structured by the axial core 111Ba formed of metal and the rubber layer 112Ab formed thereupon, and the water supply roller 112B is structured by the axial core 111Ba formed of metal and the rubber layer 111Bb formed thereupon.

For the control members 113A, 113B, rotating or fixed round bar is used. Further, as the control members 113A, 113B, a plate-like blade can also be used.

The water W in the tank 130, is drawn up in the water supply tanks 114A, 114B by the pump 131 (shown in FIG. 5), by the overflow, it is circulated from the overflow pipe 116 into the tank 130, the water level of the supply tanks 14A, 114B is maintained constant. Hereupon, the water supply tanks 114 and 114B are communicated, and the water level in both is maintained constant at the same level.

In the humidification processing, the humidification rollers 111A, 111B, the water supply rollers 112A, 112B, are respectively rotated as shown by the arrow mark, and give the water to both surfaces of the sheet S and the humidification processing is conducted.

Because the humidification rollers 111A, 111B, the water supply rollers 112A, 112B, are arranged around the conveyance path HR2 left and right symmetrically as shown in the drawings, the water supply path from the water supply tank 114A to the humidification rollers 111A, and the water supply path from the water supply tank 114B to the humidification rollers 111B are the same in the shape and the length.

Accordingly, the uniform water supply is conducted in the thickness direction of the sheet S and the flatness of the sheet S is finely maintained.

Numerals 117A, 117B are fans for blowing the dry wind on the both surfaces of the sheet S, and when the 117A and the 117B blow the dry wind to the sheet S, the surplus water is evaporated from the sheet S just after the humidification and prevents the conveyance path forming member such as rollers from the accumulation of the water.

Figure 4:
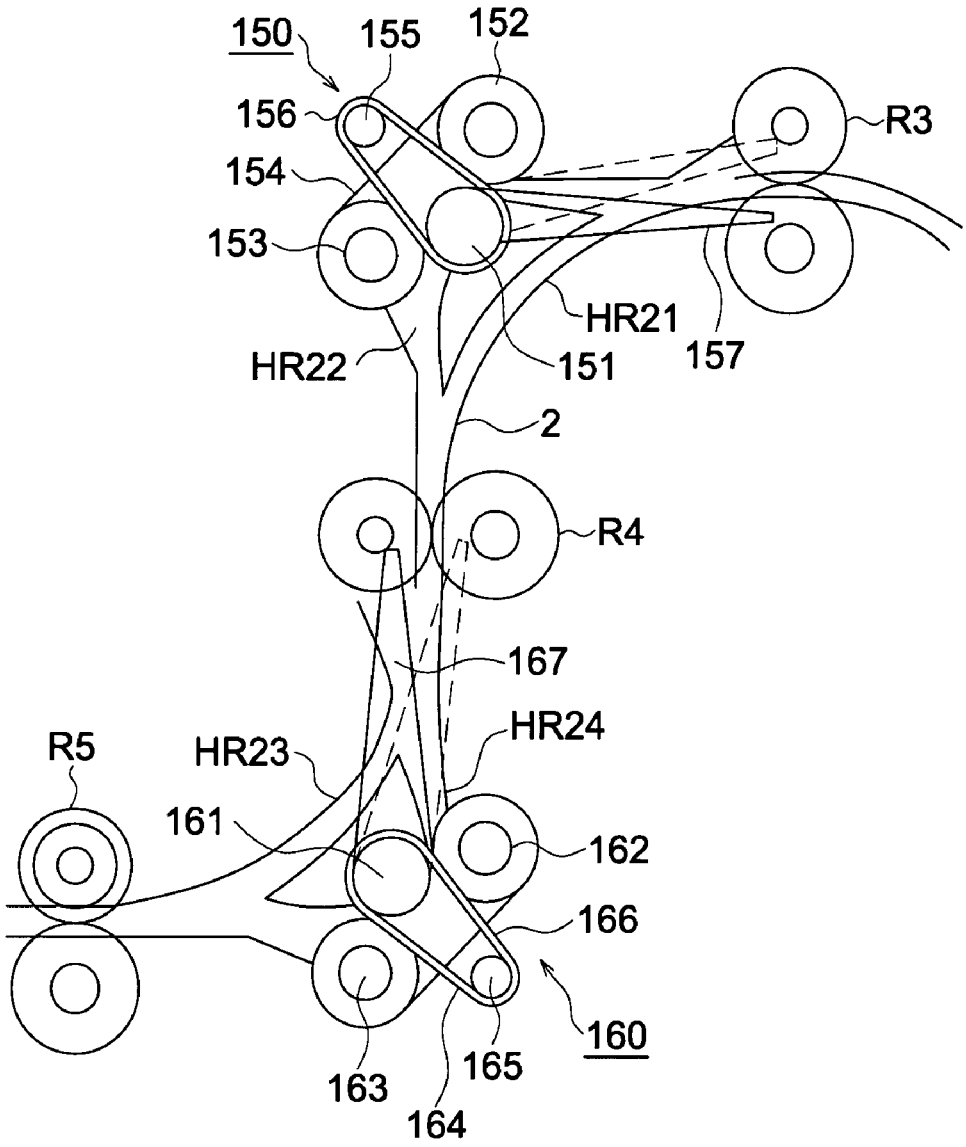
FIG. 4 is an enlarged view of the curl correcting section.

FIG. 4 is an enlarged view of the curl correcting sections 150, 160.

The curl correcting section 150 is structured by a small diameter roller (for example, radius 7 mm), 151, a pair of belt drive rollers 152, 153, and the belt 154 trained around the belt drive rollers 152, 153. Numeral 155 is a spring beg shaft, numeral 156 is a pressure spring for pressing the small diameter roller 151 to the belt 154.

Numeral 157 is a switching gate for switching the conveyance path, when the switching gate 157 is at the position of dotted line, the conveyance path HR21 which does not pass the curl correcting section 150 is selected, when is at the solid line, the conveyance path HR22 which passes the curl correcting section 150 is selected.

Because the conveyance path HR21 has a large radius of curvature as shown in the view (for example, radius is 60 mm), when the sheet S passes the conveyance path HR21, the curl correction is not conducted. In contrast to that, when passes the conveyance path HR22 formed of the small diameter roller 151 and the belt 54, the sheet S receives the bending force by the small diameter roller 151 and the belt 154, the curl is corrected. That is, the sheet S curled like that whose central portion is a valley, becomes the corrected flat plate-like.

The curl correcting section 160 is structured by the small diameter roller (for example, radius is 7 mm), a pair of belt drive rollers 162, 163 and the belt 164 trained around the belt drive rollers 162, 163. Numeral 165 is the spring peg shaft, numeral 166 is the pressure spring for pressing the small diameter roller 161 to the belt 164.

Numeral 167 is a switching gate for switching the conveyance path, when the switching gate 167 is at the position of dotted line, the conveyance path HR23 which does not pass the curl correcting section 160 is selected, when is at the solid line, the conveyance path HR24 which passes the curl correcting section 160 is selected.

Because the conveyance path HR23 has a large radius of curvature as shown in the view (for example, radius is 60 mm), when the sheet S passes the conveyance path HR23, the curl correction is not conducted. In contrast to that, when passes the conveyance path HR, the sheet S receives the bending force by the small diameter roller 161 and the belt 164, the curl is corrected. That is, the sheet S curled like that whose central portion is a mountain, becomes the corrected flat plate-like.

The sheet processing apparatus B has a no process mode, a humidification mode in which only the humidification processing is conducted, the first curl correction mode in which only the curl correction is conducted, and the second curl correction mode in which the humidification and the curl correction are conducted.

In the no processing mode, by the switching gate 102, the conveyance path HR2 is selected, and by the switching gates 167, 167, the conveyance paths HR21, HR23 are respectively selected, and the sheet conveyance is conducted.

In the mode in which only the humidification processing is conducted, by the switching gate 102, the conveyance path HR3 is selected, and the switching gates 157, 167, the conveyance paths HR21, HR23 are respectively selected, and the sheet S advances from the conveyance path HR1 to HR3, and after the humidification processed by the humidifying section 110, at the position of the conveyance roller R2, advances to the conveyance path HR2, passes the conveyance paths HR21, HR23, and is delivered.

In the mode in which only the curl correction is conducted, there are a mode in which the lower curl mode correction is conducted and a mode in which the upper curl mode is correction.

In the mode in which the lower curl correction is conducted, the conveyance path HR2 is selected by the switching gate 102, and by the switching gate 157, the conveyance path HR22 is selected, and by the switching gate 167, the conveyance path HR23 is selected.

The sheet S passes the selected conveyance path, by the curl correcting section 150, the lower curl is corrected and is delivered.

In the mode in which the upper curl correction is conducted, by the switching gate 102, the conveyance path HR2 is selected, and by the switching gate 157, the conveyance path HR21 is selected, and by the switching gate 167, the conveyance path HR24 is selected.

The sheet S passes the selected conveyance path, by the curl correcting section 160, the upper curl is corrected, and is delivered.

In the mode in which the humidification processing and the curl correction are conducted, there are a mode in which the lower curl correction is conducted, and a mode in which the upper curl correction is conducted.

In the mode in which the lower curl correction is conducted, the conveyance path HR3 is selected by the switching gate 102, and by the switching gate 157, the conveyance path HR22 is selected, and by the switching gate 167, the conveyance path HR23 is selected.

The sheet S passes the conveyance path HR3, after the humidification processing is conducted by the humidifying section 110, by the curl correcting section 150, the lower curl is corrected, and is delivered.

In the mode in which the upper curl correction is conducted, by the switching gate 102, the conveyance path HR3 is selected, and by the switching gate 157, the conveyance path HR21 is selected, and by the switching gate 167, the conveyance path HR24 is selected.

Figure 5:
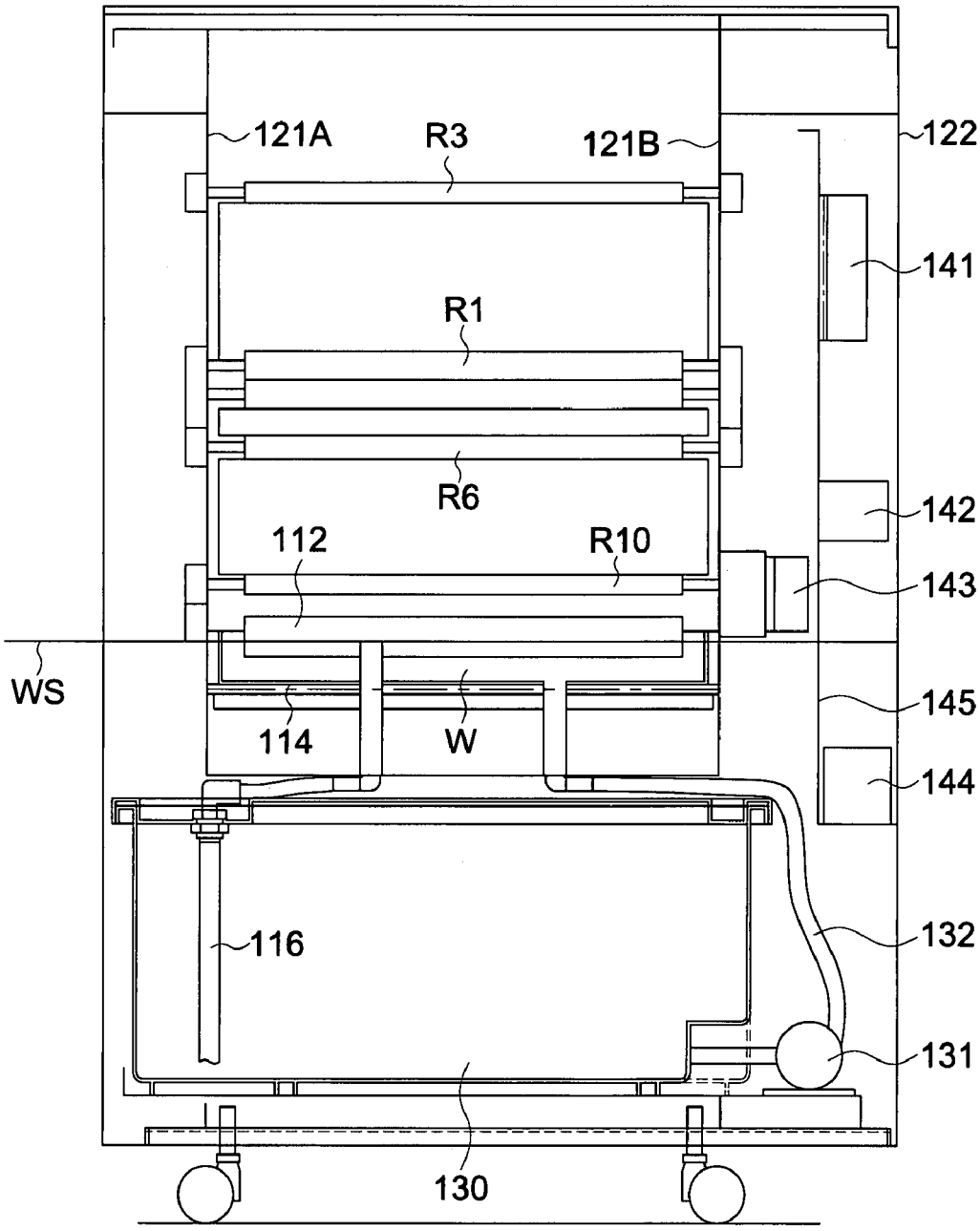
FIG. 5 is a sectional view of the sheet processing apparatus viewed from the sheet introduction side in FIG. 1.

The sheet S passes the selected HR3, after the humidification processed by the humidifying section 110, by the curl correcting section 160, the upper curl is corrected, and is delivered. FIG. 5 is a sectional view of the sheet processing apparatus B viewed from the sheet introduction side in FIG. 1.

On the side of the conveyance path HR3, each kind of electrical part is arranged.

The sheet conveyance paths HR1, HR2, HR3 are sectioned by the panels 121A, 121B supporting the conveyance rollers, and in the space sectioned by the panel 121B and the outer packaging 122 of the sheet processing apparatus B, the electrical parts are arranged.

That is, the electrical parts 143 including the control substrate 141, DC power source 142, motor 143 for driving the conveyance roller, humidification roller, and water supply roller, and socket, noise filter, and breaker are arranged in the space formed by the panel 121B and the outer packaging 122.

Numeral 145 is a water roof panel as the water proof section by which the electrical parts are covered and shielded from the water. Numeral 131 is a pump by which the water is supplied from the tank 130 to the water supply tank 114, and numeral 132 is a water feed pipe by which the water is sent from the tank 130 to the water supply tank.

As described above, the humidifying section 110 including the water supply tank 114 (the water supply tanks 114A and 114B in FIGS. 1, 2, are collected and shown as 114 in FIG. 5) is guided by the rails 120A, 120B (shown in FIG. 1), and can be inserted and detached, further, the tank 130 is guided by the rails 130A, 130B (shown in FIG. 1), and can be inserted and detached.

Then, there is a possibility that the water is splashed when the humidifying section 110 or the tank 130 is inserted and detached. Therefore, the safety part by which the electrical parts are protected from the water, is necessary.

In the present embodiment, the electrical parts is arranged upper than the water surface WS of the water W accommodated in the water supply tank 114 or the electrical parts arranged lower than the water surface WS are protected from the water. As shown in the drawings, the control substrate 141, DC power source and motor 143 are arranged upper than the water surface WS of the water supply tank 114, and the electrical parts 144 arranged lower than the water surface WS are protected from the water by the water proof panel 145.

By such a safety part, an accident such as the electrical leakage or short circuit due to the attaching of the water to the electrical parts is prevented and the deterioration of the electrical parts due to the attaching of the water is prevented.

Figure 6:
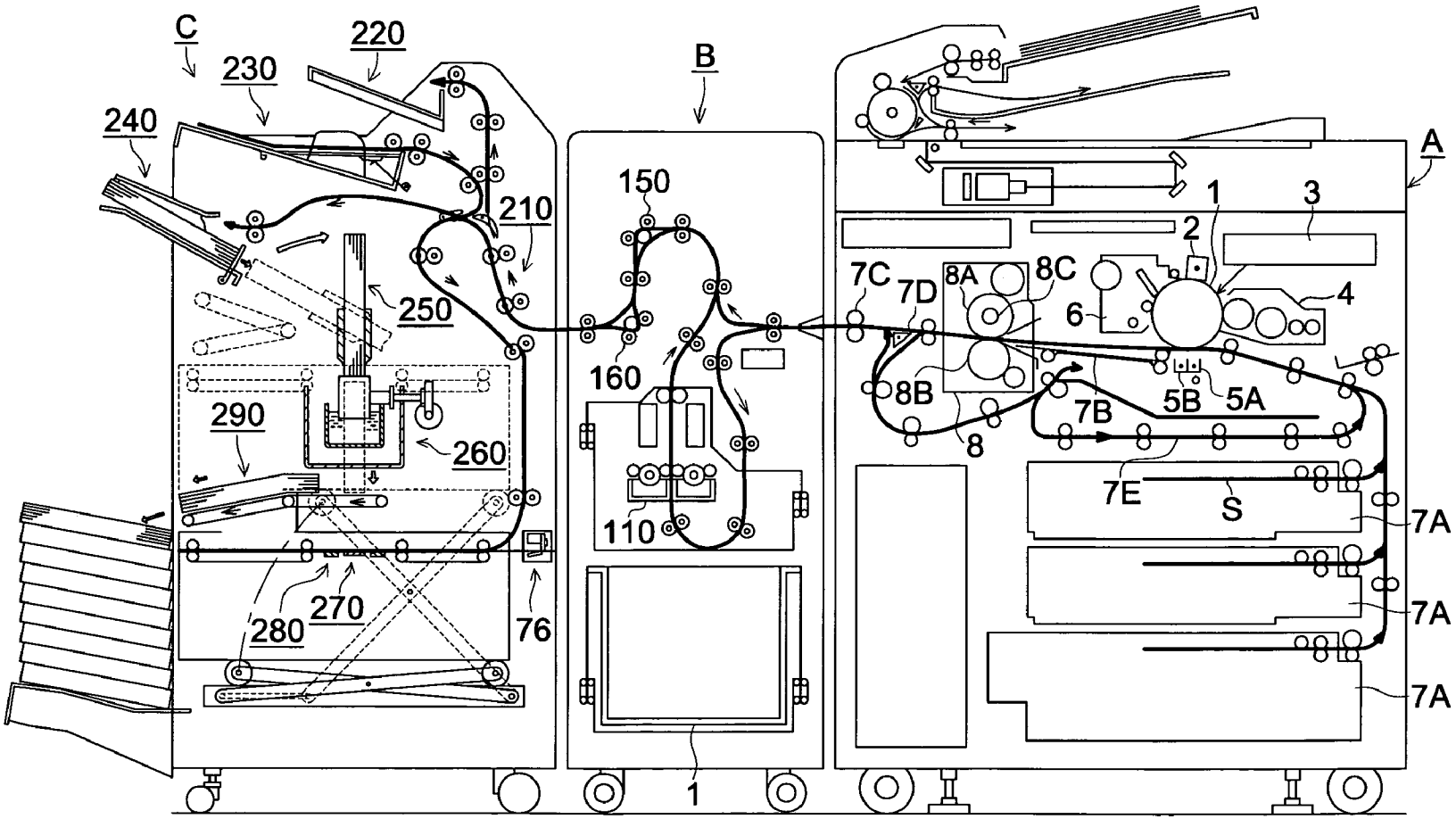
FIG. 6 is a whole structural view of an image forming system according to the embodiment of the present invention.

FIG. 6 is a whole structural view of the image forming system provided with the image forming apparatus A, sheet processing apparatus B and bookbinding apparatus C, according to the embodiment of the present invention.

The image forming apparatus A has, around the rotating photoreceptor 1, the image forming section in which the charge section 2, image exposure section (writing section) 3, development section 4, transfer section 5A, discharge section 5B, and cleaning section 6 are arranged. The image forming section conducts as follows, after uniform charging is conducted on the surface of the photoreceptor 1 by the charge section 2, the exposure scanning according to the image data read from the document is conducted by the laser beam of the image exposure section 3, and a latent image is formed, the latent image is reversal-developed by the development section 4, and the toner image is formed on the surface of the photoreceptor 1.

The sheet S fed from the sheet accommodation section 7A, is sent to the transfer position. At the transfer position, the toner image is transferred onto the sheet S by the transfer section 5A. After that, in the sheet S, the electric charge of the rear surface is discharged by the discharge section 5B, and the sheet S is separated from the photoreceptor 1, conveyed by the conveyance section 7B, succeedingly heating-fixed by the fixing section 8, and delivered from the sheet delivery roller 7C.

The fixing section 8 has a heating roller 8A, a pressing roller 8B for pressure-contacting with the heating roller 8A, and a heater 8C, by the heating roller 8A heated by the heater 8C, unfixed toner image is heated, toner is fused and the toner image is fixed on the sheet S.

When the image formation is conducted on double surfaces of the sheet S, the sheet S heating-fixed by the fixing section 8, is branched from the ordinary delivery sheet path by a conveyance path switching plate 7D, switch backed in a reversal conveyance section 7E, after the front and the rear are reversed, passes again the image forming section, the image is formed on the rear surface of the sheet S, and through the fixing section 8, delivered from the delivery sheet roller 7C to the outside of the apparatus. The sheet S delivered from the delivery sheet roller 7C is sent into the pasting bookbinding apparatus C.

On the surface of the photoreceptor 1 after the image processing, the development agent remained on the surface is removed by the cleaning section 6, and the surface is ready for the next image formation.

The sheet processing apparatus B conducts the sheet processing, as described above, in the humidification mode in which no processing is conducted and the sheet S is conveyed or only the humidification processing is conducted, the first curl correction mode in which only the curl correction is conducted, or the second curl correction mode in which the humidification and the curl correction are conducted.

These modes are selected by the setting in the control section (not shown) of the image forming apparatus A or the command from the outside device through the network.

The bookbinding apparatus C is structured by the sheet conveyance section 210, sheet delivery section 220, book cover supply section 230, 2-sheets bundle accommodation section 240, sheet bundle conveyance section 250, pasting section 260, book cover pasting section 270, book cover folding section 280, booklet delivery section 290. Each of above-described sections is arranged in the vertical row in the vertical direction in the pasting bookbinding apparatus main body.

When the sheet conveyance is set, the conveyance path to the sheet bundle accommodation section 240 is shut out, and the conveyance path to the sheet delivery section 220 is opened.

When the bookbinding mode is set, the sheet S is accommodated in a predetermined position of the sheet bundle accommodation section 240, successively piled, and the sheet bundle formed of a predetermined number of sheets S is formed. The sheet bundle on the sheet bundle accommodation section 240 is sent to the sheet bundle holding section 250, in the situation that the sheet bundle holding section 250 is rotated and in the almost vertical, the paste is pasted on the bottom surface of the sheet bundle and the sheet bundle is bundled.

To the bundled sheet bundle, the book cover is supplied from the book cover pasting section 270 and the book cover is jointed, and the book cover is folded by the book cover folding section 280 and the booklet is formed.

Formed booklet is delivered from the second humidifying apparatus by the booklet delivery section 290.

According to the above embodiments, there is no case that even when the water in the supply tank is splashed by the vibration, the water is attached to the electrical parts, the accident of the deterioration of or the electric leaking of the electrical parts is prevented, and the sheet humidifying apparatus whose durability and the safety are high, is realized.

What is claimed is:

1. An image forming system, comprising:

an image forming section to form an image on a sheet;

a fixing section to fix the image formed on the sheet; and a sheet processing unit having:

a sheet conveying passage to convey the fixed sheet from the fixing section;

a humidifying roller arranged on the sheet conveying passage and to come in contact with the sheet conveyed on the sheet conveying passage so as to humidify the sheet;

a water supplying tank to feed water to the humidifying roller;

a pair of supporting members between which the humidifying roller is supported and the water supplying tank is located;

a housing to form an enclosed space in which the sheet conveying passage, the humidifying roller, the water supplying tank and the pair of supporting members are accommodated;

an electric component; and a waterproofing member including a partition member provided between a side wall of the housing and one of the pair of supporting members, wherein the electric component is arranged between the partition member and the side wall so that the electric component is protected from being in contact with water droplets by the partition member.

2. The image forming system described in claim 1, wherein the electric component is arranged at a position above the level of water accommodated in the water supplying tank.

3. The image forming system described in claim 1, wherein the partition member is a partition plate.

4. The image forming system described in claim 1, wherein the electric component is one of an electric distributing component, a motor, and a control base board.

5. The image forming system described in claim 1, wherein the humidifying roller and the water supplying tank are detachable from the housing.

6. The image forming system described in claim 1, further comprising:

a water storage tank; and a water feeding device to supply water from the water storage tank to the water supplying tank.

7. The image forming system described in claim 6, wherein the water storage tank is detachable from the housing.

8. The image forming system described in claim 1, wherein the electric component includes a plurality of electric components so that the plurality of electric components are protected from being in contact with water droplets by the partition member.

9. The image forming system described in claim 8, wherein at least one of the plurality of electric components is located at a position lower than the level of water accommodated in the water supplying tank.

10. A sheet processing apparatus, comprising:

a sheet conveying passage to convey a sheet;

a humidifying roller arranged on the sheet conveying passage and to come in contact with the sheet conveyed on the sheet conveying passage so as to humidify the sheet;

a water supplying tank to feed water to the humidifying roller;

a pair of supporting members between which the humidifying roller is supported and the water supplying tank is located;

a housing to form an enclosed space in which the sheet conveying passage, the humidifying roller, the water supplying tank and the pair of supporting members are accommodated;

an electric component; and a waterproofing member including a partition member provided between a side wall of the housing and one of the pair of supporting members, wherein the electric component is arranged between the partition member and the side wall so that the electric component is protected from being in contact with water droplets by the partition member.

11. The sheet processing apparatus described in claim 10, wherein the humidifying roller and the water supplying tank are detachable from the housing.

12. The sheet processing apparatus described in claim 10, wherein the electric component is arranged at a position above the level of water accommodated in the water supplying tank.

13. The sheet processing apparatus described in claim 10, further comprising:

a water storage tank; and a water feeding device to supply water from the water storage tank to the water supplying tank.

14. The sheet processing apparatus described in claim 13, wherein the water storage tank is detachable from the housing.

15. The sheet processing apparatus described in claim 10, wherein the electric component includes a plurality of electric components so that the plurality of electric components are protected from being in contact with water droplets by the partition member.

16. The sheet processing apparatus described in claim 15, wherein at least one of the plurality of electric components is located at a position lower than the level of water accommodated in the water supplying tank.

* * * * *